US006904636B2

(12) United States Patent
Hwang et al.

(10) Patent No.: US 6,904,636 B2
(45) Date of Patent: Jun. 14, 2005

(54) DECK-TO-GIRDER CONNECTIONS FOR PRECAST OR PREFABRICATED BRIDGE DECKS

(75) Inventors: Yoon-Koog Hwang, Seoul (KR); Hyeong-Yeol Kim, Gyeonggi-do (KR); Ki-Tae Park, Gyeonggi-do (KR); Young-Ho Lee, Gyeonggi-do (KR); Sun-Myung Kim, Seoul (KR)

(73) Assignee: Korea Institute of Construction Technology, Gyeonggi-do (KR)

( * ) Notice: Subject to any disclaimer, the term of this patent is extended or adjusted under 35 U.S.C. 154(b) by 0 days.

(21) Appl. No.: 10/674,398

(22) Filed: Oct. 1, 2003

(65) Prior Publication Data

US 2005/0011148 A1 Jan. 20, 2005

(30) Foreign Application Priority Data

Jul. 15, 2003 (KR) ..... 10-2003-0048399

(51) Int. Cl.[7] ..... E01D 19/12
(52) U.S. Cl. ..... 14/73; 248/188.2; 404/70
(58) Field of Search ..... 14/73, 73.1, 77.1, 14/78; 404/70; 248/188.2

(56) References Cited

U.S. PATENT DOCUMENTS 5,311,629 A * 5/1994 Smith ..... 14/73.1
5,617,599 A * 4/1997 Smith ..... 14/73
5,802,652 A * 9/1998 Smith ..... 14/73
5,867,854 A * 2/1999 Matteo et al. ..... 14/73
5,901,396 A * 5/1999 Ahlskog et al. ..... 14/77.1
5,987,680 A * 11/1999 Sakaya ..... 14/73
6,073,293 A * 6/2000 Ahlskog et al. ..... 14/73
6,317,915 B1 * 11/2001 Grearson ..... 14/73

* cited by examiner

*Primary Examiner*—Robert E. Pezzuto
*Assistant Examiner*—Alexandra K. Pechhold
(74) *Attorney, Agent, or Firm*—Dickstein Shapiro Morin & Oshinsky LLP

(57) ABSTRACT

A technique and apparatus for integrally connecting a precast or prefabricated deck to a girder. A connection structure and method for connecting a precast or prefabricated deck to a girder, makes it unnecessary to form shear pockets in the deck and to remove existing shear connectors already installed to the girder, and makes it possible to easily adjust an elevation of the deck and to obtain excellent structural integration between the girder and the deck. The connection structure includes at least one rod shaped elevation adjustor inserted through the deck to support the deck spaced apart from an upper surface of the girder at a predetermined interval. A length of the rod shaped elevation adjustor projected toward an upper face of the girder can be changed to allow the deck to be supported. At least one shear connector is inserted through the deck. A lower portion of the shear connector extends toward the upper surface of the girder, and an upper portion of the shear connector is fastened by at least one fastener. When the deck is supported at a predetermined elevation spaced apart from the upper surface of the girder by the elevation adjustor after the deck is placed on the girder, a filler material is filled in a space between the girder and the deck to encase the lower portions of the elevation adjustor and the shear connector. The fastener is fastened to the shear connector so as to press the deck downward.

3 Claims, 12 Drawing Sheets

DECK-TO-GIRDER CONNECTIONS FOR PRECAST OR PREFABRICATED BRIDGE DECKS

BACKGROUND OF THE INVENTION

1. Field of the Invention

The present invention relates to deck-to-girder connections for precast or prefabricated bridge decks and construction methods thereof, particularly, which allow for structural integration by causing either a bridge deck made from precast concrete (hereinafter, referred to as a "precast concrete deck") or a bridge deck made from prefabricated fiber reinforced plastic (hereinafter, referred to as a "FRP deck") to be firmly connected to the girders of a bridge system.

2. Description of the Prior Art

When installing a new precast deck after removal of an existing deck, or installing a new precast deck on new girder bridge, the most common method of structurally connecting the girders with the precast deck is to use what is called a "shear pocket." The method includes forming or placing the shear pocket in the deck. At least one shear connector is provided on the upper portion of a girder. The precast deck is placed on the upper surface of the girders so that the shear connector is located in the shear pocket. Filling materials such as concrete grout are filled in the shear pocket. As a result, the precast deck is integrally connected to the girders. However, this conventional connection structure has problems as follows:

When connecting the precast deck to the girder system, for example as in building a bridge, there are difficulties as follows. The precast deck is fabricated to have a certain curvature in the transverse and longitudinal directions of the bridge so as to facilitate drainage of the superstructure of the bridge according to the bridge design specifications. By contrast, an upper flange of the girder is fabricated without taking into consideration the curvature of the precast deck as mentioned above. Thus, when the precast deck with a certain curvature is installed on the girder system without any curvature, the installation process must take into consideration whether or not the curvature exists, and then installation is carried out through adjustment of a horizontal position, an elevation, of the precast deck. However, because the precast deck is heavy, it is very difficult to adjust the elevation of the precast deck. Moreover, because this adjustment is completely dependent on a manual work, there is a drawback in that constructability is very poor.

When installing a new precast deck after an existing deck is removed in order to rehabilitate a bridge, there are different difficulties in addition to the forgoing drawback, as follows.

First, since the existing deck, which has been already provided on the girder, is provided as a cast-in-place deck, the existing deck must be removed in order to provide a new deck again. However, after the existing deck is removed, there remain various members, such as shear reinforcing bars, shear connectors, etc., which have been used to connect the existing deck to the girder. Therefore, to install the precast deck, which is formed with a shear pocket, on the existing girder as mentioned above, there is inconvenience in that, after shear connectors, etc., which remain at the girder, are removed, new shear connectors, etc., must be positioned and provided in the shear pocket of the deck.

Second, in the foregoing conventional connection structure using the shear pocket, because the shear pockets have predetermined positions, sizes, numbers, etc., on fabricating the precast deck, there is limitation in that the shear pocket cannot be formed in appropriate correspondence to various situations at a construction site generated during installation.

BRIEF SUMMARY OF THE INVENTION

Accordingly, the present invention is directed to overcome the above-mentioned disadvantages or limitations occurring in the conventional connection structure for integrally connecting a precast deck to the girders, in the case either of connecting a new precast deck to the existing girders again or of initially connecting a new precast deck to the new girders.

The present invention also provides a connection structure and method for connecting a precast deck to girders, making it unnecessary to form shear pockets in the precast deck and to remove shear connectors which have been already installed to the girders, and of making it possible to easily adjust an elevation of the deck and to obtain excellent structural integration between the girder and the precast deck.

BRIEF DESCRIPTION OF THE DRAWINGS

The above and other objects, features and advantages of the present invention will be more apparent from the following detailed description taken in conjunction with the accompanying drawings, in which:

FIG. 1A is a sectional view showing a state before an existing deck is removed, and FIG. 1B is a sectional view showing a state after an existing deck is removed;

FIG. 2A is a cross-sectional view taken along line A—A of FIG. 2B to show a state in which a new precast concrete deck is placed on and coupled to a girder, FIG. 2B is a partial top plan view of a precast concrete deck for indicating cross-sectional lines of FIGS. 2A and 2C, FIG. 2C is a cross-sectional view taken along line B—B of FIG. 2B, and FIG. 2D is a perspective view showing a circled part A of FIG. 2C in detail;

FIG. 3 is a perspective view showing the conventional FRP deck having a multi-cellular cross-sectional structure in a transverse direction, wherein each cell has a cross-sectional shape of a polygon, such as a trapezoid, a quadrangle, a pentagon or the like;

FIG. 4A is a perspective view showing a state before an anchor block is installed, and FIG. 4B is a right side view seen on the right side of FIG. 4A, and FIG. 4C is a cross-sectional view taken along line C—C of FIG. 4B;

DETAILED DESCRIPTION OF THE INVENTION

Figure 1A:
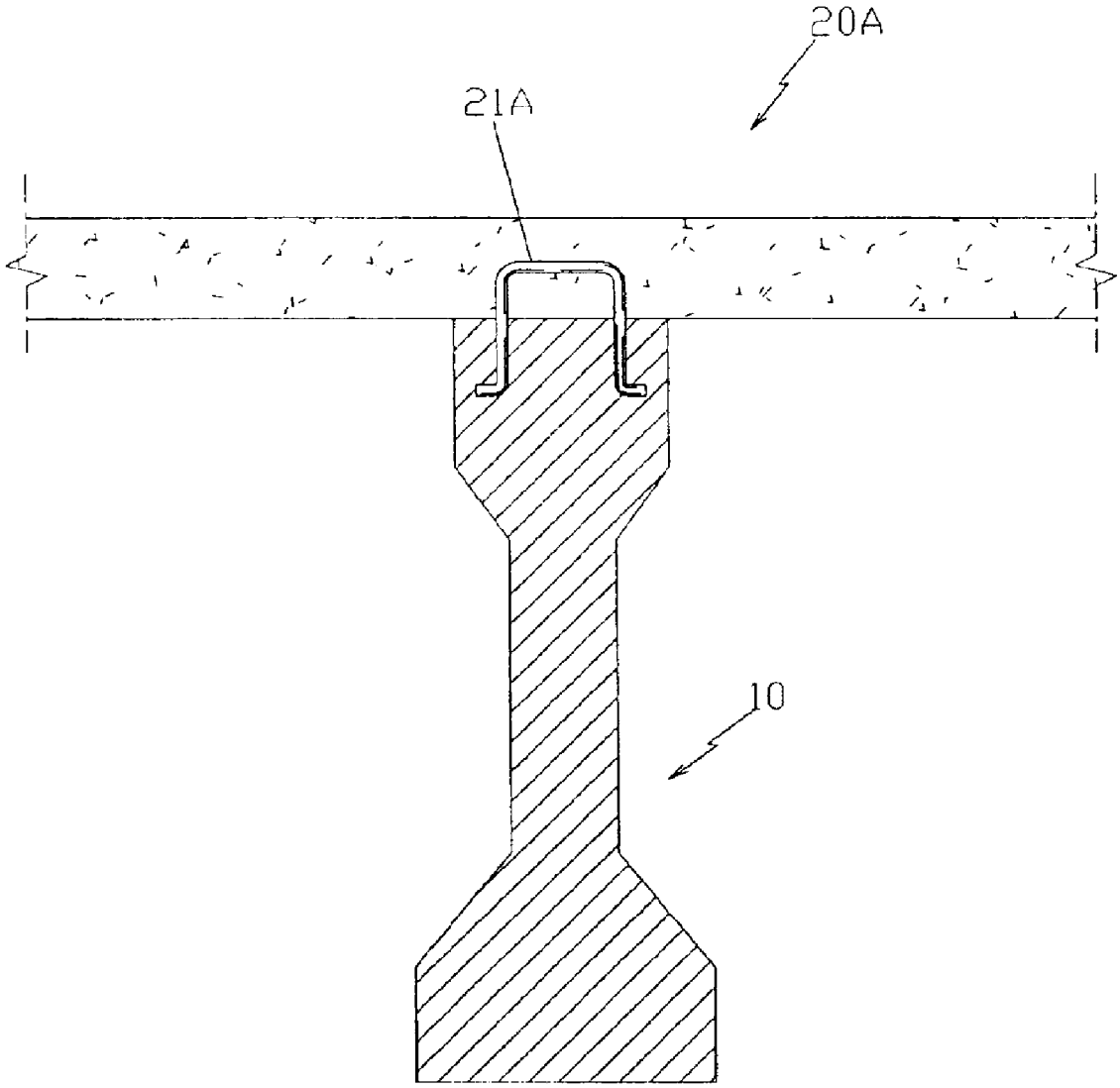
Fig.1A (Prior Art)
FIGS. 1A and 1B are reference views showing a conventional method of connecting a new precast concrete deck to an existing girder, where

Hereinafter, exemplary embodiments of the present invention will be described with reference to the accompanying drawings. In the following description and drawings, the same reference numerals are used to designate the same or similar components, and so repetition of the description on the same or similar components will be omitted.

Figure 1B:
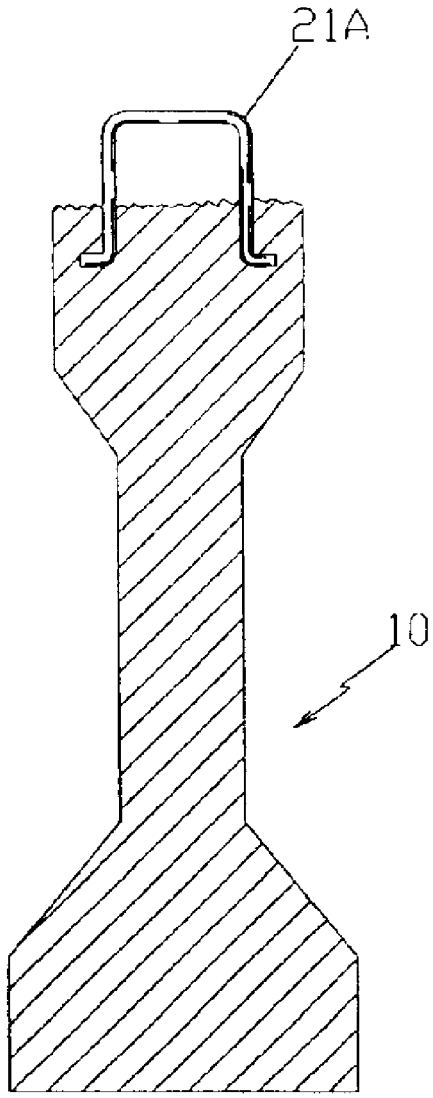
Fig.1B (Prior Art)

FIGS. 1A and 1B are reference views showing a conventional method of connecting a new precast concrete deck to an existing girder. In particular, FIG. 1A is a sectional view showing a state before an existing deck is removed, while FIG. 1B is a sectional view showing a state after an existing deck is removed.

In order to install a new precast concrete deck to an existing girder, first a cast-in-place deck 20A installed on an upper surface of the existing girder 10 is removed. Subsequently, as shown in FIG. 1B, the upper surface of the existing girder 10 is roughly treated, and then preferably covered with primer. Removal of the previous deck 20A results in exposing reinforcing bars 21A, each of which is used as a shear connector connected with the existing deck 20A. The exposed reinforcing bars 21A preferably are subjected to anti-rust treatment by application of an anti-rust agent.

Figure 2A:
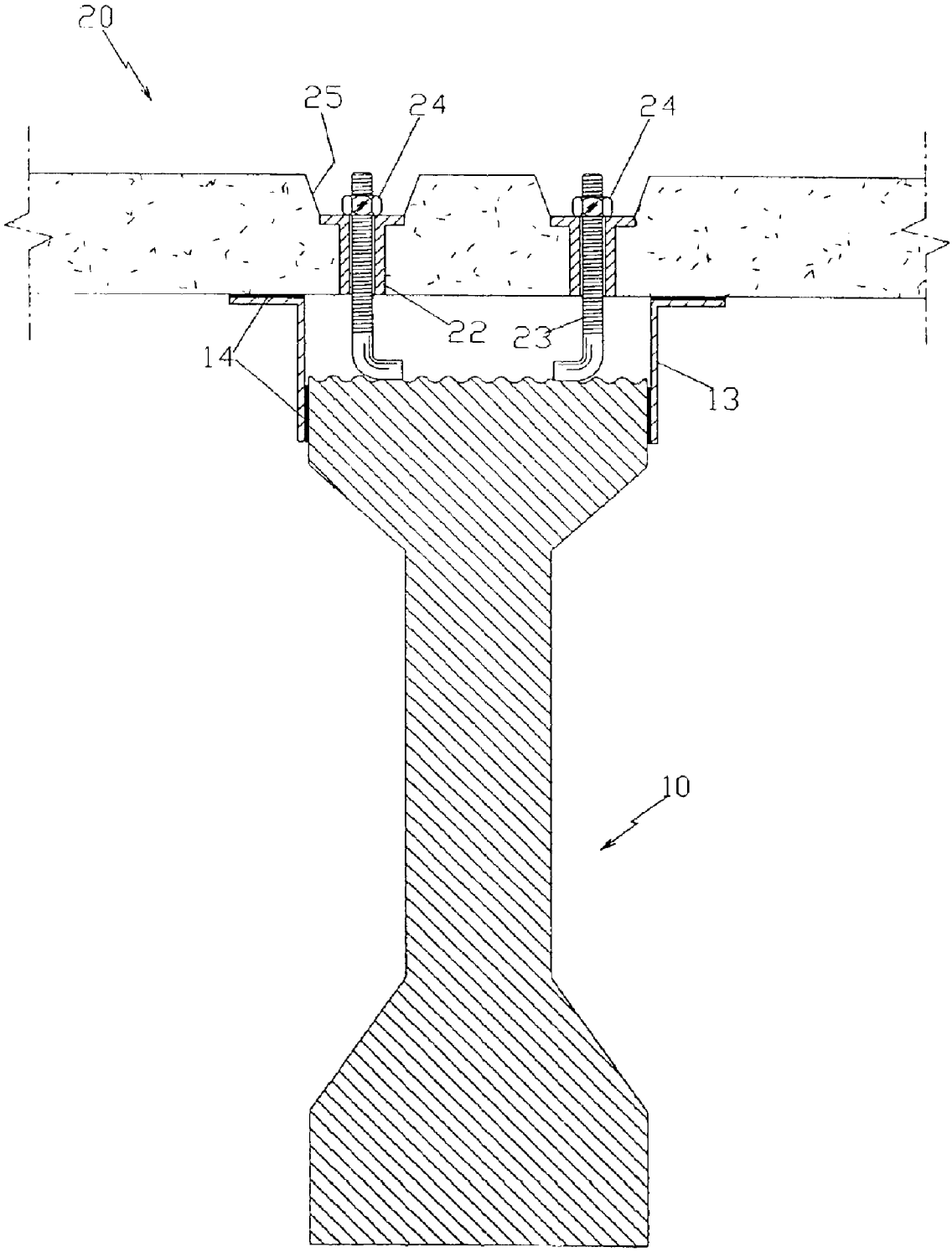
FIGS. 2A to 2D are schematic views for explaining one embodiment of a connection structure according to the present invention, where
Figure 2B:
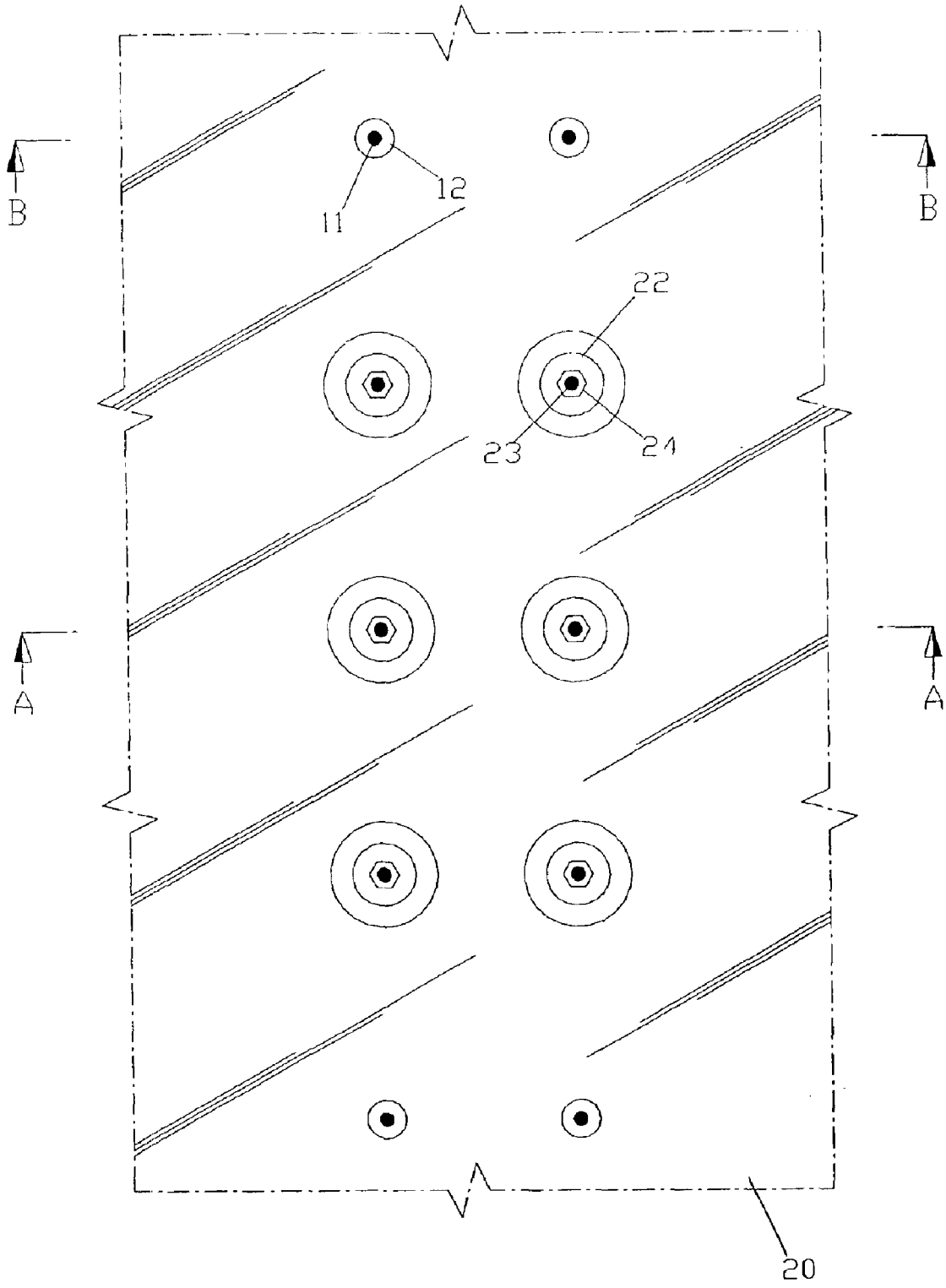
Figure 2C:
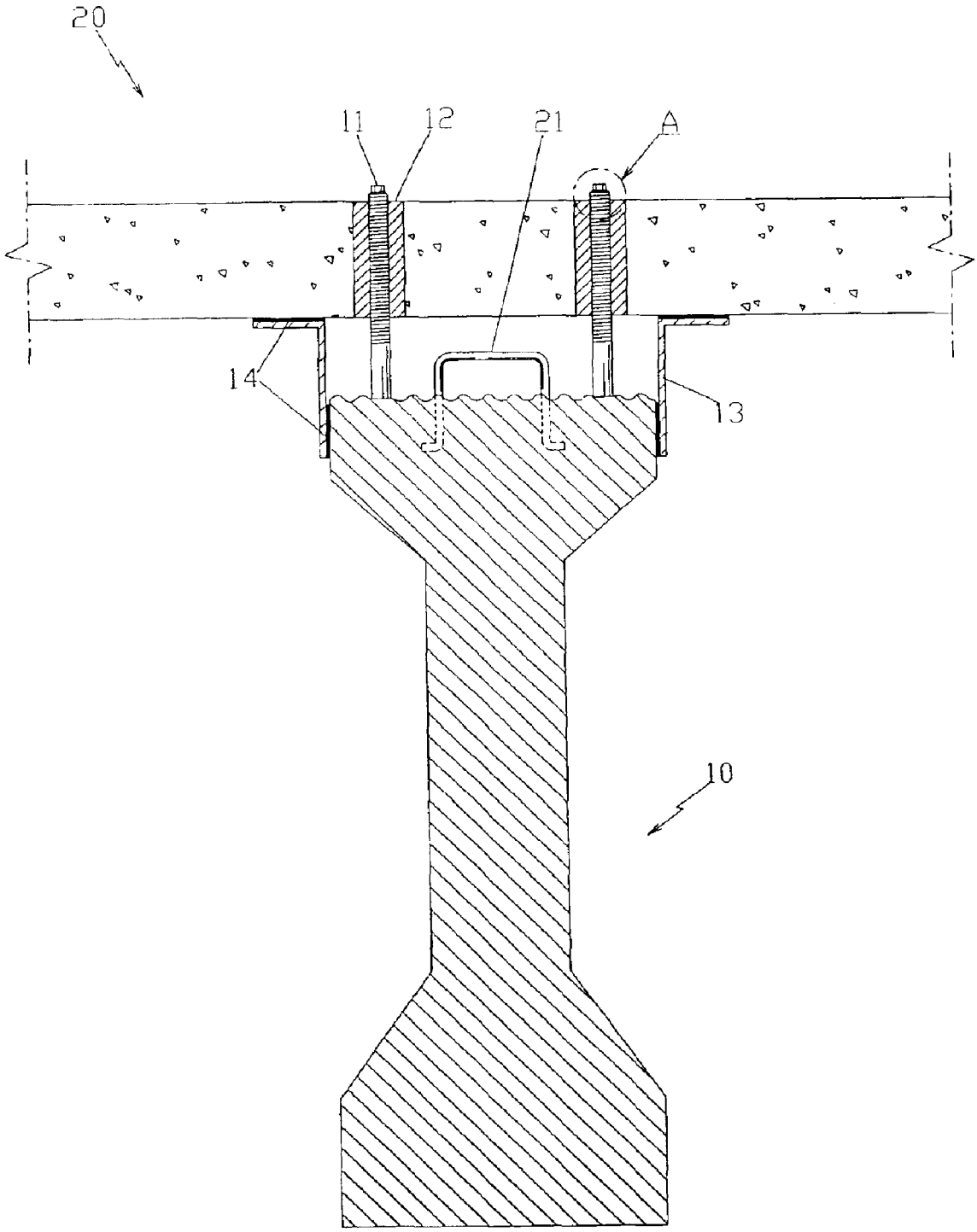

After such anti-rust treatment, a new precast concrete deck 20 is installed on the girder 10. FIG. 2A is a sectional view showing new precast concrete deck 20 installed on and coupled to an existing concrete girder 10 according to an exemplary embodiment of the present invention. FIG. 2B is a partial top plan view showing a precast concrete deck 20, wherein cross-sectional lines for FIGS. 2A and 2C are indicated. FIG. 2A is a cross-sectional view taken along line A—A of FIG. 2B. FIG. 2C is a cross-sectional view taken along line B—B of FIG. 2B.

The precast concrete deck 20 is provided with a plurality of first sleeves 22, which pass through the precast concrete deck 20 at positions along which the girder 10 is located. Bar shaped shear connectors 23, each formed as a stud, are inserted into each of the first sleeves 22, respectively. One end of the bar shaped shear connector 23 projects outside the first sleeve 22. The projected end of the bar shaped shear connector 23 is fastened with fastener 24, preferably provided as a nut, respectively. As shown in FIG. 2A, recess 25 is formed around the projected end of the bar shaped shear connector 23 in the precast concrete deck 20. The fastener 24 is disposed in the recess 25.

The precast concrete deck 20 is previously fabricated at a factory or at the construction site. At this time, the first sleeves 22, the shear connectors 23 and the fasteners 24 are all coupled to the precast concrete deck 20. The previously fabricated precast concrete deck 20 is lifted, and positioned on the girder 10 so that the other end of the shear connector 23 is supported on the upper surface of the girder 10. The other end of the shear connector 23 does not always need to come into contact with the upper surface of the girder 10. Thus, it may be slightly spaced apart from the upper surface of the girder 10.

Meanwhile, in the case of a structure such as a bridge, a deck has longitudinal and transverse curvatures to a certain level. Thus, when a new deck is provided after removal of an existing deck, an elevation of the new deck must be matched with that of the roadway. According to the present invention, when the precast concrete deck 20 is installed on the girder 10, the following construction is provided to be capable of adjusting the elevation of the precast concrete deck 20.

FIG. 2C is a cross-sectional view taken along line B—B of FIG. 2B, and shows a construction, proposed by the present invention, for adjusting the elevation of the precast concrete deck 20. The precast concrete deck 20 is provided with a plurality of second sleeves 12. Bar shaped elevation adjustors 11 are inserted into the second sleeves 12, respectively. Each of the bar shaped elevation adjustors 11 is firmly inserted into each second sleeve 12 such that its length projected toward the upper surface of the girder 10 can be adjusted by a worker. For instance, when the elevation adjustor 11 has an outer surface threaded, and when the second sleeve 12 has an inner surface threaded in correspondence to the threaded outer surface, the elevation adjustor 11 is threaded with the second sleeve 12. The elevation adjustor 11 and the second sleeve 12 are installed to the deck 20 when the precast concrete deck 20 is previously fabricated in a factory or around a construction site, for example.

A lower end of the elevation adjustor 11 is positioned at an elevation of installing the precast concrete deck 20, and the precast concrete deck 20 is lifted and seated on the girder 10. The lower end of the elevation adjustor 11 comes into contact with the upper surface of the girder 10, thus supporting the precast concrete deck 20. After the precast concrete deck 20 is seated on the girder 10, an upper end of the elevation adjustor 11 is cut to prevent it from being projected. As shown in FIG. 2B, the elevation adjustors 11 are located at predetermined locations in the longitudinal direction of the girder 10.

Figure 2D:
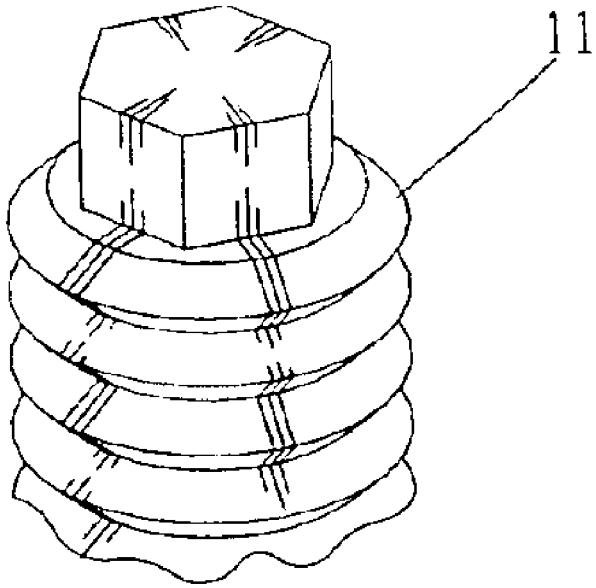

As mentioned above, the precast concrete deck 20, which is provided with the first and the second sleeves 22 and 12, the shear connectors 23, the fasteners 24 and the elevation adjustors 11, are previously fabricated and seated on the upper surface of the girder 10. Here, the elevation adjustors 11 support the precast concrete deck 20, the elevation of which is dependent on the length of the elevation adjustors 11 which is previously adjusted and projected downward. When the precast concrete deck 20 is not maintained at a desired elevation, the elevation of the precast concrete deck 20 can be easily adjusted by turning each elevation adjustor 11 to adjust its projected length. FIG. 2D is a perspective view showing a circled part A of FIG. 2C in detail. FIG. 2D shows one embodiment of a construction for turning each elevation adjustor 11 with ease. As shown in FIG. 2D, an upper end of the elevation adjustor 11 is formed in a shape of a polygonal bolt, the elevation adjustor 11 is easily turned using a tool such as a polygonal wrench, so that its projected length can be adjusted.

In this manner, after the precast concrete deck 20 is installed at the upper portion of the girder 10, a side form 13 is installed around the upper portion of the girder 10 in order to fill a space between the upper surface of the girder 10 and the lower surface of the precast concrete deck 20 (see FIGS. 2A and 2B). The side form 13 can be simply installed using an adhesive agent or a set anchor. After the side form 13 is installed, the space between the upper surface of the girder 10 and the lower surface of the precast concrete deck 20 is filled with a filler material, for example non-shrink mortar.

After the filler material is hardened, the fastener 24 is firmly fastened to the upper end of the shear connector 23 projected through the first sleeve 22. For instance, in the case of forming a thread on the upper end of the shear connector 23, and of realizing the fastener 24 as a nut, the nut is turned and tightened, so that the nut is firmly fastened to the shear connector 23 while endowing the precast concrete deck 20 with a downward pressure. In this structure, shear connection is provided between the precast concrete deck 20 and the girder 10. Further, frictional connection is additionally provided, which is caused by the downward pressure generated while the fastener 24 is fastened to the shear connector 23. Therefore, the precast concrete deck 20 and the girder 10 are firmly and securely coupled each other. By contrast, in the case that the upper end of each connector 23 or each elevation adjustor 11 is projected beyond the upper surface of the precast concrete deck 20, the upper end is cut. Any necessary finishing work is completed.

The foregoing embodiments are directed to removing an existing precast concrete deck and then installing a new precast concrete deck, but they may be similarly applied to the case of installing a new precast concrete deck to a new girder. In the foregoing embodiments, the first sleeves 22 may be removed. To be more specific, the precast concrete deck 20 may be formed with a plurality of through-holes, and then the shear connectors 23 may be inserted into and pass through the through-holes without the first sleeves 22. Reference numeral 21 indicates reinforcing bars, which have been already provided to the girder 10.

Figure 3:
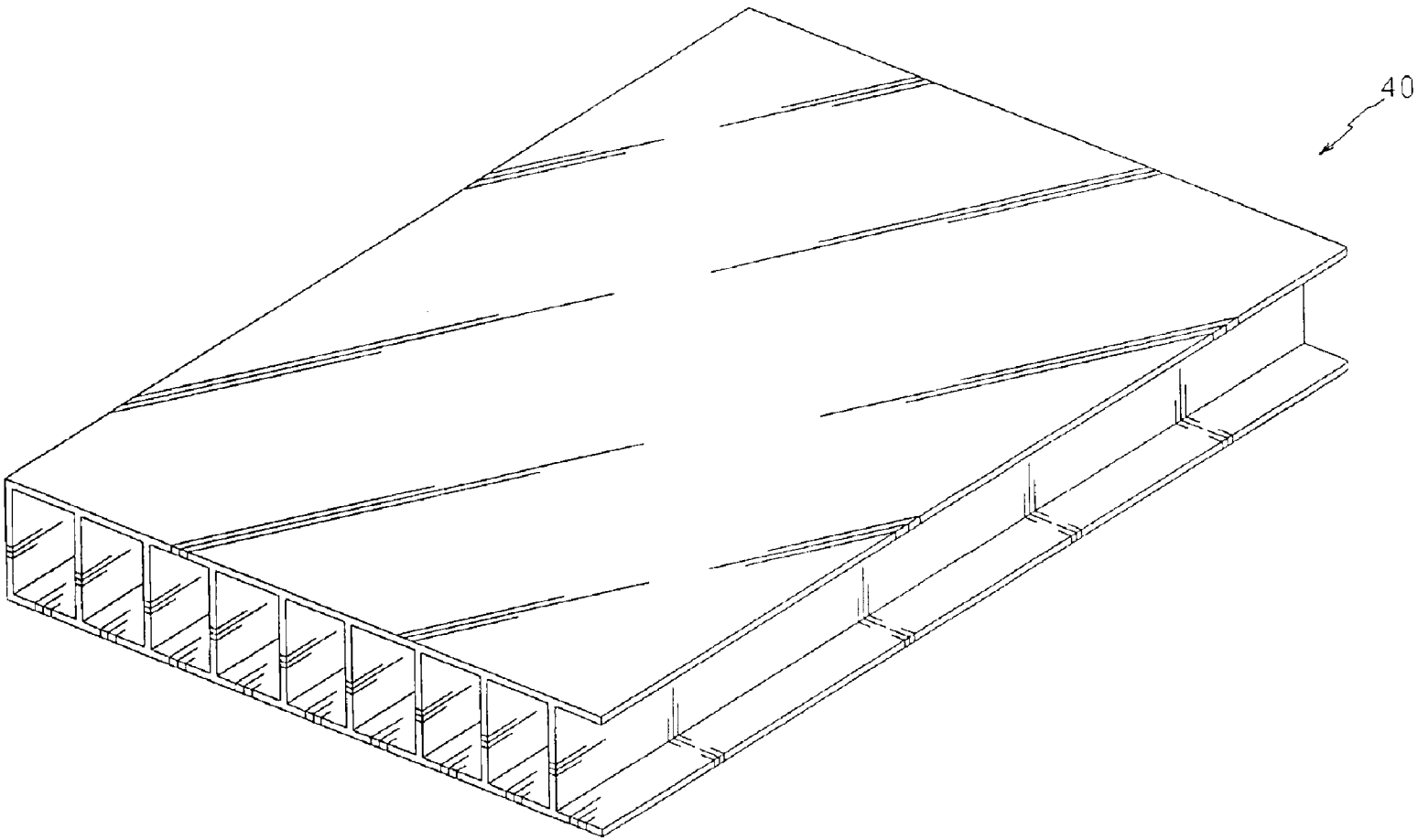

Next, description will be made regarding an embodiment of installing a FRP deck instead of the precast concrete deck. FIG. 3 is a perspective view showing the conventional FRP deck 40 having a multi-cellular cross-sectional shape in a transverse direction, wherein each cell has a cross-sectional shape of a polygon, such as a trapezoid, a quadrangle, a pentagon or the like. This FRP deck 40 itself has been widely known. For this reason, a detailed description of the FRP deck 40 will be not be provided. It should be understood that the term "FRP deck" throughout the specification refers not only to a deck fabricated by combination of resin with fiber, such as glass fiber or the like, but also to all kinds of decks having a multi-cellular cross-sectional shape as shown in FIG. 3 and made of various materials, such as aluminum, steel and so on.

Figure 4A:
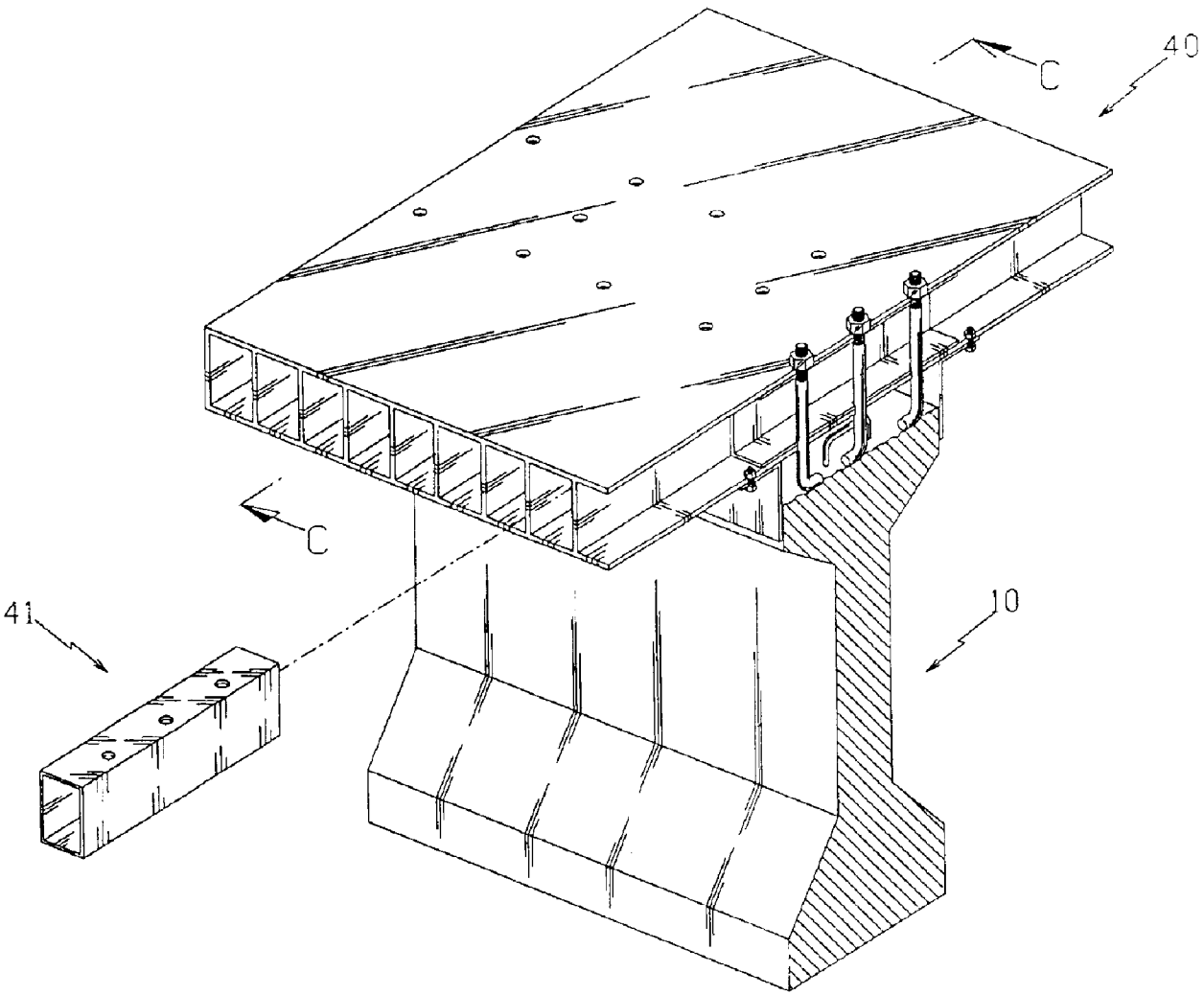
FIGS. 4A to 4C show a connection structure for connecting a FRP deck to a girder, where
Figure 4B:
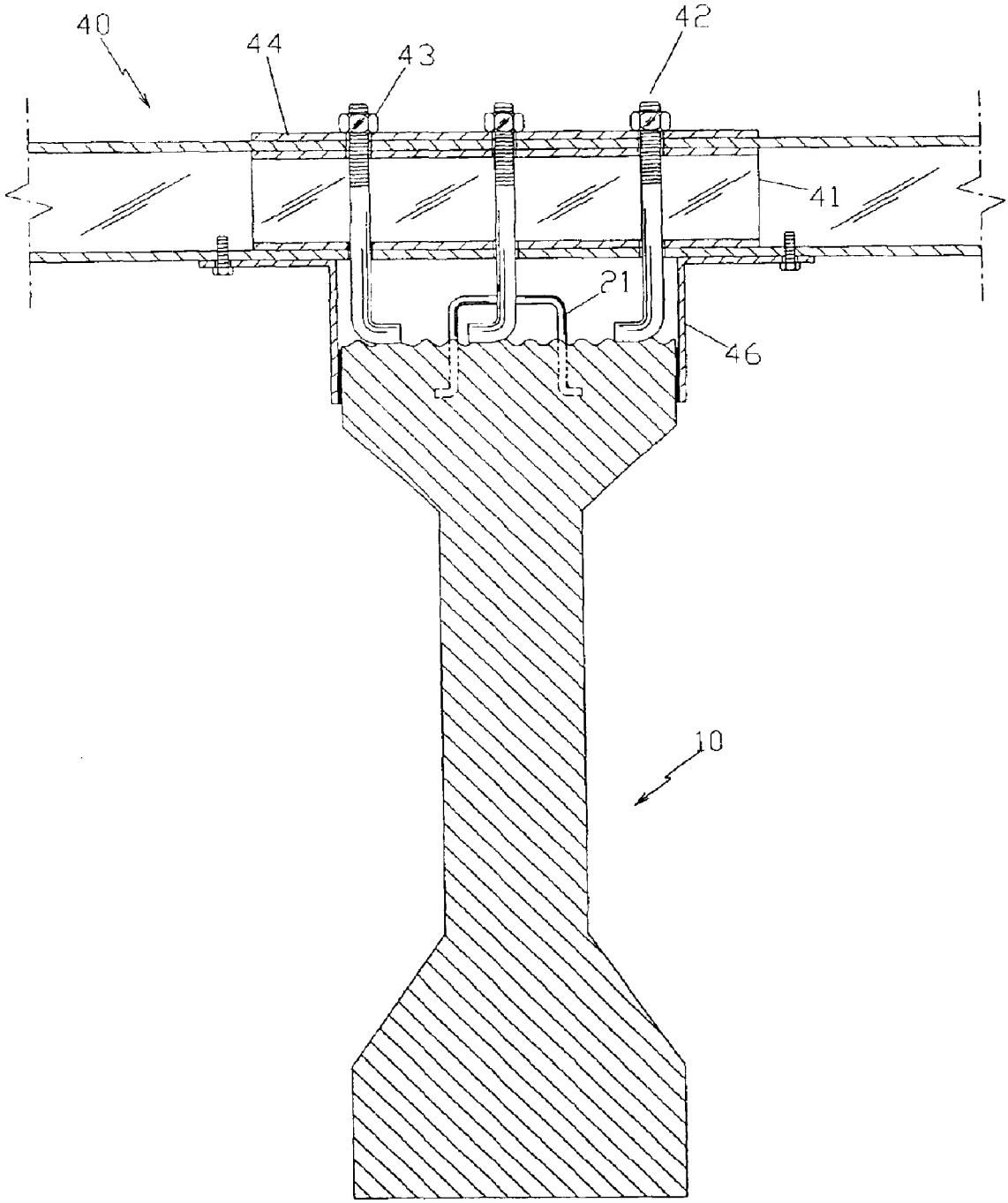
Figure 4C:
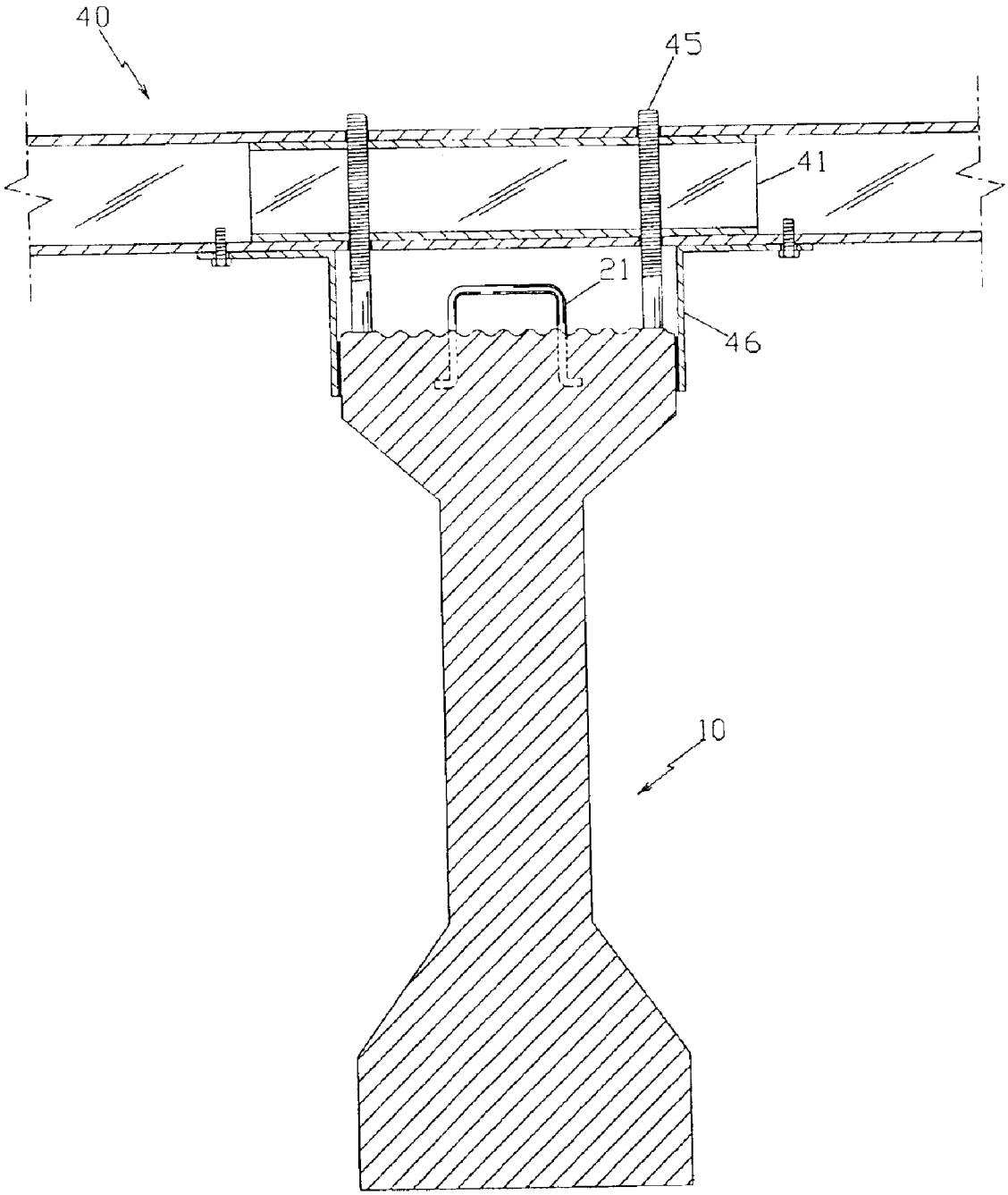

FIGS. 4A to 4C show a structure for providing FRP deck-to-girder connections according to the present invention. In particular, FIG. 4A is a perspective view showing a state before an anchor block 41 is installed. FIG. 4B is a sectional view showing a connection state seen on the right side of FIG. 4A. FIG. 4C is a cross-sectional view taken along line C—C of FIG. 4B.

When building a bridge by installing a new FRP deck after removal of an existing deck, a procedure of treating and priming an upper surface of the girder 10 after removal of the existing deck is same as in the foregoing case of installing the precast concrete deck.

In the FRP deck 40 installed on the upper surface of the girder 10, as shown in FIG. 4A, an anchor block 41 having a cross-sectional profile similar to that of each cell of the FRP deck 40 is inserted into the FRP deck 40 which is to be connected with the girder 10. As shown in FIG. 4B, after the anchor block 41 is disposed in the FRP deck 40, bar shaped shear connectors 42 are each provided to pass through all the upper and lower surfaces of the FRP deck 40 and the anchor block 41. When a lower end of the shear connector 42 comes into contact with the upper surface of the girder 10, an upper end of the shear connector is tightened with a fastener 43 such as a nut. If necessary, a separate cover plate 44 made of fiber reinforced material or high strength material may be provided for reinforcement between the upper surface of the FRP deck 40 and the fastener 43 before the fastener 43 is tightened.

The anchor block 41 is preferably made of a corrosion resistant material, but may be made of fiber reinforced plastic material, concrete, aluminum and so on. Further, the anchor block 41 may be formed in a shape of, but not limited to, a hollow box, as shown in FIG. 4A. For instance, the anchor block 41 may be formed in a shape of a solid box. To this end, the anchor block 41 may be fabricated in such a manner that it is made of a corrosion resistant material in a hollow box shape, and then its inner hollow space is filled with a polymeric material such as polyurethane in order to prevent deformation.

When installing the FRP deck 40 using shear connector 42, a separate elevation adjustor may be used. As shown in FIG. 4C in a sectional view, upper and lower flanges of the FRP deck 40 are provided with a plurality of through-holes. Each of the bar shaped elevation adjustors 45 is inserted through the through-holes, respectively, thus allowing for supporting the FRP deck 40. At the same time, a length of a lower end of each elevation adjustor 45 is adjusted to adjust an elevation of the FRP deck 40. As shown in FIG. 4C, it is preferred that the anchor block 41, which has a cross-sectional profile corresponding to that of the respective cell of the deck 40, is inserted and disposed in the deck 40 at a position where the elevation adjustor 45 is installed, and that the elevation adjustor 45 passes through the deck 40 and the anchor block 41. However, the anchor block 41 may be removed when the elevation adjustor 45 is installed.

In order to allow the elevation of the deck 40 to be adjusted through adjustment of the length of the lower end of each elevation adjustor 45, the elevation adjustors 45 must be installed to the FRP deck 40 so that the elevation adjustor 45 can be moved up and down only through manipulation by a worker. To this end, the upper and lower flanges of the FRP deck 40 are provided with a plurality of through-holes, and then an inner surface of each through-hole is threaded, and an outer surface of each elevation adjustor 45 is threaded to correspond to the threaded inner surface of each through-hole. As a result, the elevation adjustors 45 can be screwed to and inserted into the through-holes. Because the FRP deck 40 is lightweight, the elevation adjustor 45 can sufficiently support the FRP deck 40 only by means of screwing relative to the upper and lower flanges of the FRP deck 40. Further, in the alternative case in which the anchor block 41 is installed and that the elevation adjustor 45 is designed to pass through the FRP deck 40 and the anchor block 41, an inner surface of through-hole of the anchor block 41 is also threaded, so that the elevation adjustor 45 can be screwed to and inserted into the through-hole.

An upper end of the elevation adjustor 45 is preferably designed so that a worker easily turns each elevation adjustor 45 to adjust the projected elevation of its lower portion. This has been already described with reference to FIG. 2D, so that no repetitive description will be made.

The lower end of the elevation adjustor 45 is adjusted to an installed elevation of the FRP deck 40, when the FRP deck 40 is placed on the girder 10, such that the lower end of the elevation adjustor 45 comes into contact with the upper surface of the girder 10 to support the FRP deck 40. After the FRP deck 40 is installed, an upper end of the elevation adjustor 45 is cut to prevent it from projecting above the deck surface. Elevation adjustors 45 do not need to extend over the whole length of the girder 10. Thus, it will do if the elevation adjustors 45 are located at predetermined locations in a longitudinal direction of the girder 10.

Alternatively, the foregoing elevation adjustor 45 may be removed. In this case, some of the shear connectors 42 are installed so as not to allow for movement in the through-holes without manipulation by a worker, thus being capable of substituting for a function of the elevation adjustor 45. That is to say, outer surfaces of some shear connectors 42 are each formed with a thread as the elevation adjustor 45. Through-holes of the upper and lower plates of the FRP deck 40, through which the shear connectors 42 pass, are each formed with the corresponding thread. The shear connectors 42 are each screwed into the through-holes of the FRP deck 40, so that each shear connector 42 functions as the elevation adjustor 45.

As mentioned above, after the new FRP deck 40 is provided with the anchor blocks 41, the shear connectors 42, the fasteners 43 and the elevation adjustors 45, the new FRP deck 40 is installed in a manner that the new FRP deck 40 is lifted to allow the lower end of each shear connector 42 to come into contact with the upper surface of the girder 10. At this time, when it is necessary to adjust elevation of the FRP deck 40, the elevation of the FRP deck 40 is easily adjusted by positioning the elevation adjustors 45 in the through-holes, for example by turning the elevation adjustors 45.

After the FRP deck 40 is installed on the upper surface of the girder 10, a side form 46 is mounted around the upper portion of the girder 10 in order to fill a space between the upper surface of the girder 10 and the lower surface of the FRP deck 40 (see FIGS. 4B and 4C). The side form 46 can be simply mounted in a manner that one end of the side form 46 is attached to the sides of the upper portion of the girder 10 using an adhesive agent or a set anchor and the other end is coupled to the lower flange of the FRP deck 40 using a fastener such as a bolt. In this manner, after the side form 46 is mounted, the space between the upper surface of the girder 10 and the lower surface of the FRP deck 40 is filled with a filler material, for example non-shrink mortar.

After the filler material is hardened, the shear connectors 42 are firmly fastened to the FRP deck 40 by the fasteners 43 provided to the upper end of the shear connectors 42, while the shear connectors 42 endow the FRP deck 40 with a downward pressure. For instance, the upper end of each shear connector 42 is formed with a thread, and each fastener 43 is realized as a nut. When the nut is turned, the shear connectors 42 are firmly fastened, and at the same time the FRP deck 40 is subjected to downward pressure.

Thus, as in the foregoing connection structure between the precast concrete deck 20 and the girder 10, the connection structure of the present invention not only provides shear connection between the FRP deck 40 and the girder 10, but also further provides frictional connection, which is caused by the downward pressure generated while the fasteners 43 are fastened to the shear connectors 42. Therefore, comparing with the conventional connection structure, the FRP deck 40 and the girder 10 are firmly and securely coupled each other.

If the upper end of each shear connector 42 or each elevation adjustor 45 is projected beyond the upper surface of the FRP deck 40, the upper end is cut. All finishing work is completed. Whether installing a new FRP deck to an existing girder or to a new girder, the same connection structure and method may be applied. Reference numeral 21 indicates reinforcing bars, which have been already provided to the girder 10.

Figure 5:
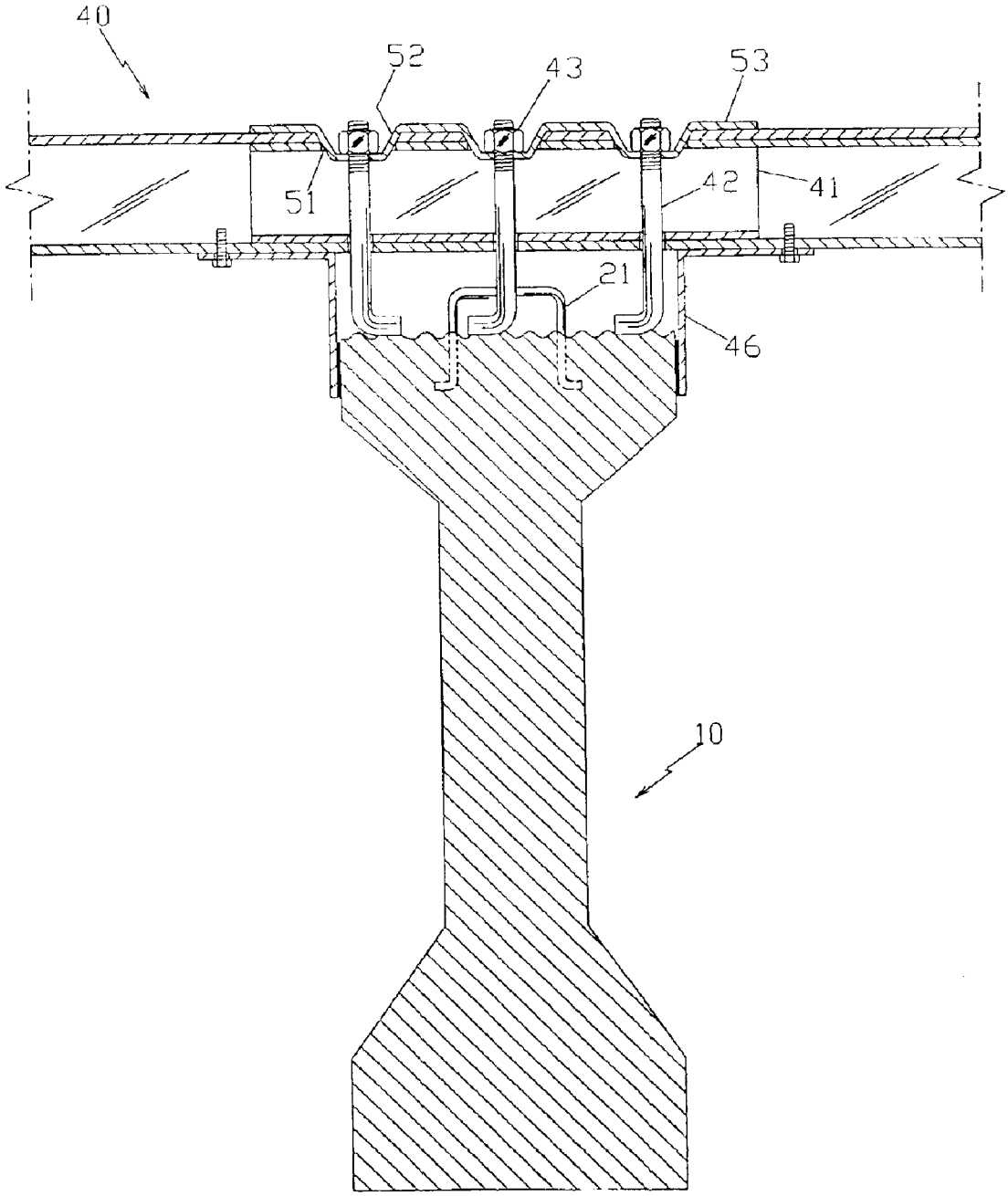
FIG. 5 is a sectional view showing a state of installing an anchor block in a FRP deck and installing shear connectors to pass through the FRP deck.

Description will be made regarding another exemplary embodiment of a structure of providing FRP deck-to-girder connection according to the present invention with reference to FIG. 5. FIG. 5 is a drawing similar to FIG. 4B, and is a sectional view showing an anchor block 41 is housed in an FRP deck 40. Shear connectors 42 are installed to pass through the FRP deck 40.

Comparing the present embodiment shown in FIG. 5 with that shown in FIG. 4B, the present embodiment is constructed to prevent an upper end of each shear connector 42 from projecting beyond an upper surface of the FRP deck 40. To be more specific, in the present embodiment, the FRP deck 40 and the anchor block 41 are each formed with a plurality of mounting holes 51, into which the shear connectors are inserted. An upper surface of the FRP deck 40 is covered with a cover plate 53 formed with a plurality of recesses 52, each of which is provided with a through-hole through which each shear connector 42 passes. The recesses 52 of the cover plate 53 are seated into the mounting holes 51.

As shown in FIG. 5, the cover plate 53 is positioned on the upper surface of the FRP deck 40 so that the recesses 52 of the cover plate 53 are inserted into the mounting holes 51 of the FRP deck 40 and the anchor block 41. Then, the shear connectors 42 are inserted through the through-holes of the recesses 52. Subsequently, each of the shear connectors 42 is fastened by each fastener 43, such as a nut, on the upper end of the shear connector and is supported on the FRP deck 40. The upper ends of the shear connectors 42 fastened by the fasteners 43 are located in the recesses 52, so that the upper ends of the shear connectors 42 can be prevented from being projected upward the upper surface of the FRP deck 40. The other constructions related to the present embodiment, such as a construction of installing the FRP deck 40 to the upper surface of the girder 10, are similar to those of the embodiment shown in FIG. 4B. For this reason, repetitive description on the other constructions will be omitted.

Figure 6:
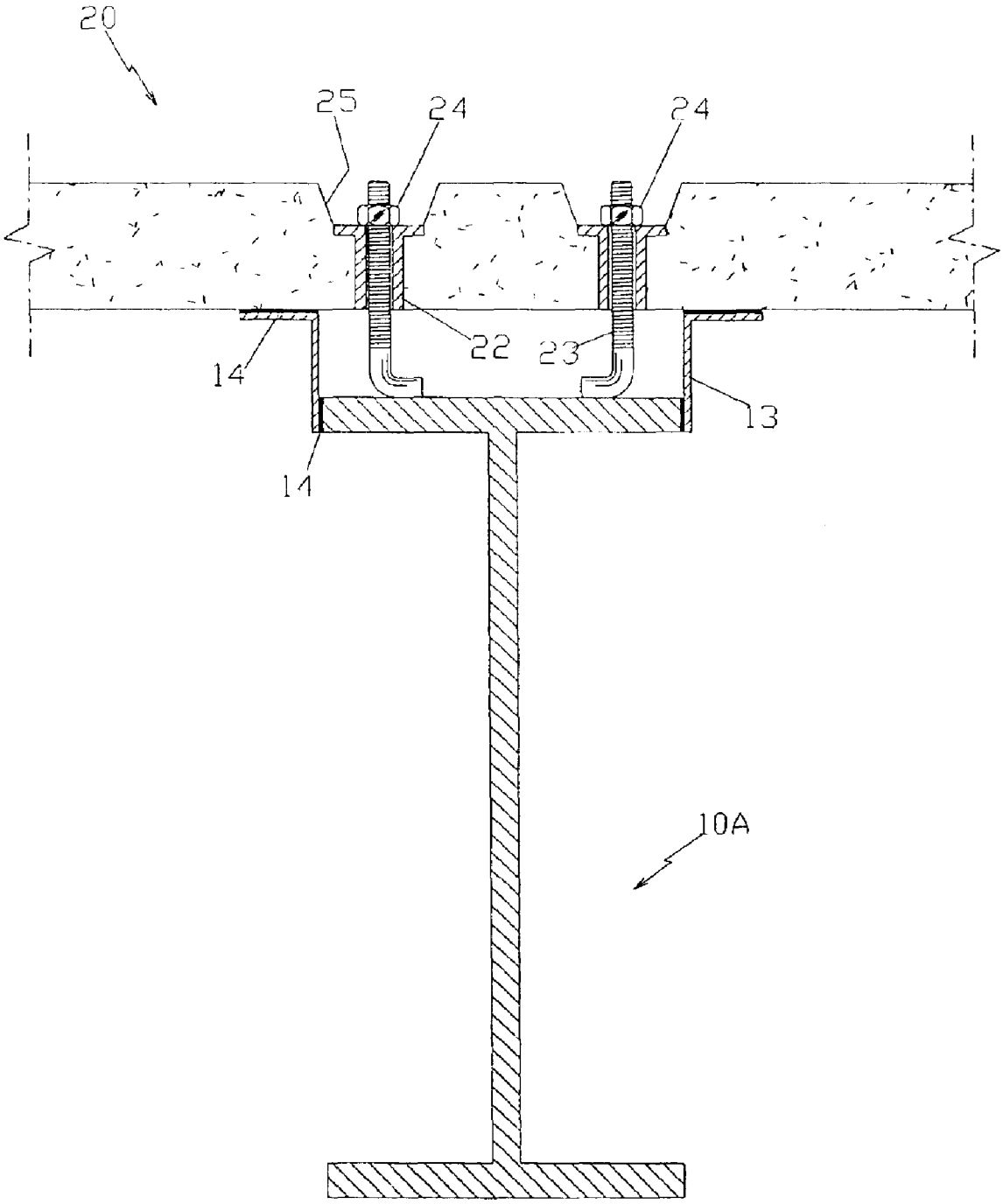
FIG. 6 shows an embodiment using a steel girder, instead of a concrete girder.

The embodiments and the related drawings mentioned hitherto illustrate the girder 10 as, but not limited to, a reinforced concrete girder. FIG. 6, as a drawing similar to FIG. 2A, shows an embodiment using a steel girder 10A, instead of the reinforced concrete girder. As shown in FIG. 6, the connection structure and method of the present invention mentioned hitherto may be similarly applied to various types of girders, such as the reinforced concrete girder, the steel girder 10A and a steel-concrete composite girder, etc.

In short, details related to the structure and method for connecting the precast concrete deck to the girder described with reference to FIGS. 2A to 2D may be similarly applied to the case of the steel girder as shown in FIG. 6. Therefore, the other similar details including the reference numerals shown in FIG. 6 will not be described for the sake of brevity.

Even though not described with reference to FIG. 6, the structure and method for connecting the FRP deck to the girder described reference to FIGS. 4A to 4C, including the structure and method for connecting the precast concrete deck to the girder, may be similarly applied to the case of the steel girder 10'.

As mentioned above, in the connection structure and method according to the present invention, it is unnecessary to form a "shear pocket" in the deck. However, in the prior art, it is essential to previously form the shear pocket in the deck, so that additional efforts are required, and moreover it is not easy to change location or quantity of the shear pockets to address situations encountered at the construction site. Furthermore, the shear pocket must be refilled with filler materials, so that the resultant additional processes are required.

Advantageously, the present invention does not require shear pockets. As a result, efforts for forming the shear pocket are not required, installation costs can be reduced and a constructability can be improved. Further, it is easy to change position or quantity of the shear pockets to address situations encountered at the construction site, so that it is possible to actively and effectively cope with various conditions at the construction site in which firmer connection between the girder and the deck is required. In addition, there is no need for an additional process in which the shear pocket must be refilled with filler materials.

In particular, according to the present invention, all the decks are fabricated at a factory, for example, and then can be connected to the girder at the construction site in a simple manner, so that the decks can provide an improved constructability with high quality control.

In the conventional connecting method, when connecting a new deck to an existing girder, there is inconvenience in that new shear connectors must be installed after all the existing shear connectors of the existing girder should be removed. However, in the present invention, because shear connectors installed to the existing girder can be utilized for a new deck, costs can be reduced and a constructability can be significantly improved.

Moreover, in the present invention, the elevation of the deck can be easily adjusted. Thus, when a new deck is installed, an elevation of the new deck can be easily matched with that of the roadway.

According to the connection structure of the present invention, the girder and the deck are more firmly connected and integrated with each other. In the prior art, the connection between the girder and the deck is dependent only on the shear connection. However, in the present invention, there is the shear connection as well as the frictional connection caused by press fastening between the shear connectors and the fasteners, so that the connection between the girder and the deck can more securely provided.

Further, in the present invention, after the deck is installed, if the connection between the girder and the deck becomes loose over time, the fasteners can be tightened again, so that it is possible to tighten the released connection between the girder and the deck again. Additionally, it is easy not only to replace deteriorated deck in the future, but also to reuse the existing shear connectors.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A deck-to-girder connection structure connecting a precast or prefabricated deck to a girder, comprising:

at least one rod shaped elevation adjustor inserted through the deck to support the deck spaced apart from an upper surface of the girder at a predetermined interval, so as to allow a length of the rod shaped elevation adjustor projected toward an upper face of the girder to be adjusted and to allow the precast deck to be supported; and at least one shear connector inserted through the deck, a lower portion of the shear connector extending toward the upper surface of the girder, an upper portion of the shear connector being fastened by at least one fastener, wherein, when the deck is supported at a predetermined elevation spaced apart from the upper surface of the girder by the elevation adjustor after the deck is placed on the girder, a filler material is filled in a space between the girder and the deck to cause the lower portions of the elevation adjustor and the shear connector to be covered by the filler material; and the fastener is fastened to the shear connector while pressing the deck downward; and wherein the deck is a deck made from fiber reinforced plastics having a multi-cellular cross-section in a transverse direction;

at least one anchor block, which has a cross-section corresponding to a single-cellular cross-section, is inserted and fitted in the fiber reinforced plastic deck to cause the shear connector to be fitted through the fiber reinforced plastic deck and the anchor block; and the elevation adjustor has an outer surface formed with a thread, and at least one through-hole of the fiber reinforced plastic deck for accepting an elevation adjustor has an inner surface formed with a thread corresponding to the thread of the outer surface of the elevation adjustor, so that the elevation adjustor is screwed with and inserted into the fiber reinforced plastic deck.

2. A deck-to-girder connection structure as claimed in claim 1, wherein:

the anchor block having the cross-section corresponding to the single-cellular cross-section is inserted and fitted in the fiber reinforced plastic deck at a position where the elevation adjustor is installed; and the elevation adjustor is screwed with and inserted into the fiber reinforced plastic deck.

3. A deck-to-girder connection structure as claimed in claim 1, wherein:

the fiber reinforced plastic deck is formed with at least one mounting hole at a position where the shear connector is installed;

the fiber reinforced plastic deck has an upper surface covered with a cover plate, the cover plate being formed with a plurality of recesses, each of the recesses being formed with a through-hole through which the shear connector passes, each recess of the cover plate being seated into the mounting hole; and after the cover plate is positioned on the upper surface of the fiber reinforced plastic deck to allow each recess of the cover plate to be seated into the mounting hole, when the shear connector is inserted through the through-hole of each recess of the cover plate, the fastener is fastened to an upper end of the shear connector, so that the shear connector is installed to the fiber reinforced plastic deck in such a manner that the upper end of the shear connector is located in each recess of the cover plate.

* * * * *